US005145415A

United States Patent [19]

Doudon

[11] Patent Number: 5,145,415

[45] Date of Patent: Sep. 8, 1992

[54] LOAD BASE WITH INTEGRAL WIRE LUG AND WIRE LUG RETAINER

[75] Inventor: Robert Doudon, Drummondville, Canada

[73] Assignee: Siemens Electric Limited, Pointe Claire, Canada

[21] Appl. No.: 670,675

[22] Filed: Mar. 18, 1991

[51] Int. Cl.[5] ..... H01R 13/68

[52] U.S. Cl. ..... 439/621; 439/830

[58] Field of Search ..... 337/214, 215; 439/152, 439/620–622, 698, 830

[56] References Cited

U.S. PATENT DOCUMENTS

| | | | |
|---|---|---|---|
| 1,025,246 | 5/1912 | Cole | 439/698 |
| 1,267,457 | 5/1918 | Sachs | 439/830 |
| 3,293,392 | 12/1966 | Cataldo et al. . | |
| 3,525,835 | 8/1970 | Norden . | |
| 3,551,876 | 12/1970 | Walter . | |
| 3,727,171 | 4/1973 | Coles et al. . | |
| 3,840,717 | 10/1974 | Pekrul et al. . | |
| 3,993,395 | 11/1976 | Taylor . | |
| 4,288,138 | 9/1981 | Berry et al. | 439/621 |
| 4,302,643 | 11/1981 | Cox et al. . | |
| 4,432,594 | 2/1984 | Daggett | 439/698 |
| 4,536,823 | 8/1985 | Ingram et al. . | |
| 4,801,278 | 1/1989 | Sappington | 439/830 |
| 4,809,132 | 2/1989 | Palmieri et al. . | |
| 4,926,110 | 5/1990 | Yoon | 439/621 |
| 4,950,195 | 8/1990 | Perreault et al. | 439/621 |

FOREIGN PATENT DOCUMENTS

| | | | |
|---|---|---|---|
| 3827911A | 3/1989 | Fed. Rep. of Germany . | |
| 2092398 | 8/1982 | United Kingdom | 439/621 |

OTHER PUBLICATIONS

Square D brochure—"QO Circuit Breaker Load Centers With Convertible Mains" Apr. 1990.

*Primary Examiner*—David L. Pirlot
*Attorney, Agent, or Firm*—Peter A. Luccarelli, Jr.

[57] ABSTRACT

A load base (10) with a housing (12) having at least one channel (14) for slidable insertion and capture of a wire lug (38), a tongue (26) having a cantilever structure attached to the housing (12) proximal the channel (14), which blocks removal of the lug (38) from the channel (14). The housing (12), channel (14) and tongue (26) are preferably integrally formed. The wire lug (38) has a unitary lug body (40) with a wire aperture (42) for receipt of a cable (34) and a platform (46). A fuse clip (48) is directly attached to the wire lug platform (46).

6 Claims, 3 Drawing Sheets

LOAD BASE WITH INTEGRAL WIRE LUG AND WIRE LUG RETAINER

BACKGROUND OF THE INVENTION

1. Field of the Invention

The present invention is directed to electrical power distribution devices; particularly load bases which provide electrical connection between a fuse and an electrical cable that is connected to a load.

2. Description of Art

Electrical distribution devices often utilize fuses for circuit protection devices. Load bases, sometimes also referred to as fuse blocks, are used to provide electrical continuity from an electrical cable to the fuse. In some applications, a load base is used on each end of a fuse, i.e., on both the so-called load and line ends of the fuse. In other applications, a disconnect switch is used on the line end of the fuse and a load base is used on the load end of the fuse, i.e., the end closer to the device which utilizes electrical power.

Known fuse bases and fusible switches generally have an insulating base and a conductive bus attached to the base which has threaded apertures for attachment of a wire lug with a threaded member, such as a machine screw. A load base has a fuse clip attached to the conductive strip and electrical continuity is established between a wire connected to a load and a fuse by connection of the wire to the wire lug and insertion of a fuse conductive end into the fuse clip. Fusible switches often have a line end similar to a load base and a set of stationary switch terminals, attached to the conductive bus in lieu of a fuse clip. The switch has a translatable blade contact assembly for completion of continuity with the stationary switch terminals and a fuse clip is electrically connected to the blade contact assembly. Examples of load bases and fusible switches are shown in U.S. Pat. Nos. 3,293,392; 3,525,835; 3,840,717; 3,993,395; 4,288,138 and 4,302,643.

Known load bases and fusible switches require attachment of the conductive bus to the insulating base with fasteners or by molding the conductive bus into the base. Some types of load bases and switches utilize fasteners for the dual purpose of mounting a lug or fuse clip to the conductive bus and in turn retaining the bus on the base. Removal of one of the fasteners causes disassembly of the components from the base that are secured by that fastener, and the components can be lost during field service.

Also, the requirement for a manufacturing facility to stock and install during assembly separate fasteners for retaining the lug to the conductive bus, the fuse clip to the conductive bus and the conductive bus to the base increases manufacturing costs.

It is an object of the present invention to create a wire lug which allows direct attachment of a fuse clip thereto without the need for an additional conductive bus strip or other like components.

It is another object of the present invention to minimize the number of components needed to establish electrical continuity between an electrical wire and a conductive end of a fuse, to minimize parts, inventory and manufacturing costs, assembly effort and discontinuities which may be caused by inadvertent component separation.

It is an additional object of the present invention to create a wire lug retainer which holds a wire lug in position relative to a load base or disconnect switch housing after removal of a fuse clip coupled to the lug.

SUMMARY OF THE INVENTION

The objects are attained by the wire lug of the present invention, which comprises a unitary lug body having an aperture for receipt of a cable and a platform for direct attachment of a fuse clip thereto.

Other aspects of the present invention are directed to a wire lug retainer comprising a housing; at least one channel formed in the housing for slidable insertion and capture of a wire lug; and a translatable tongue attached to the housing proximal the channel. The tongue has a first position which permits slidable insertion of a lug into the channel and a second position which blocks removal of a lug from the channel, while remaining attached to the housing in both positions.

The present invention is also directed to a load base comprising a wire lug having a unitary lug body with a wire aperture for receipt of a cable. The lug also has a platform. The load base also has a unitary housing having at least one channel for slidable insertion and capture of the wire lug, a translatable tongue attached to the housing proximal the channel having a first position which permits slidable insertion of the lug into the channel and a second position which blocks removal of the lug from the channel. A fuse clip is directly attached to the wire lug platform. The wire lug is removeable when the fuse clip is not installed.

DESCRIPTION OF THE PREFERRED EMBODIMENTS

Figure 1:
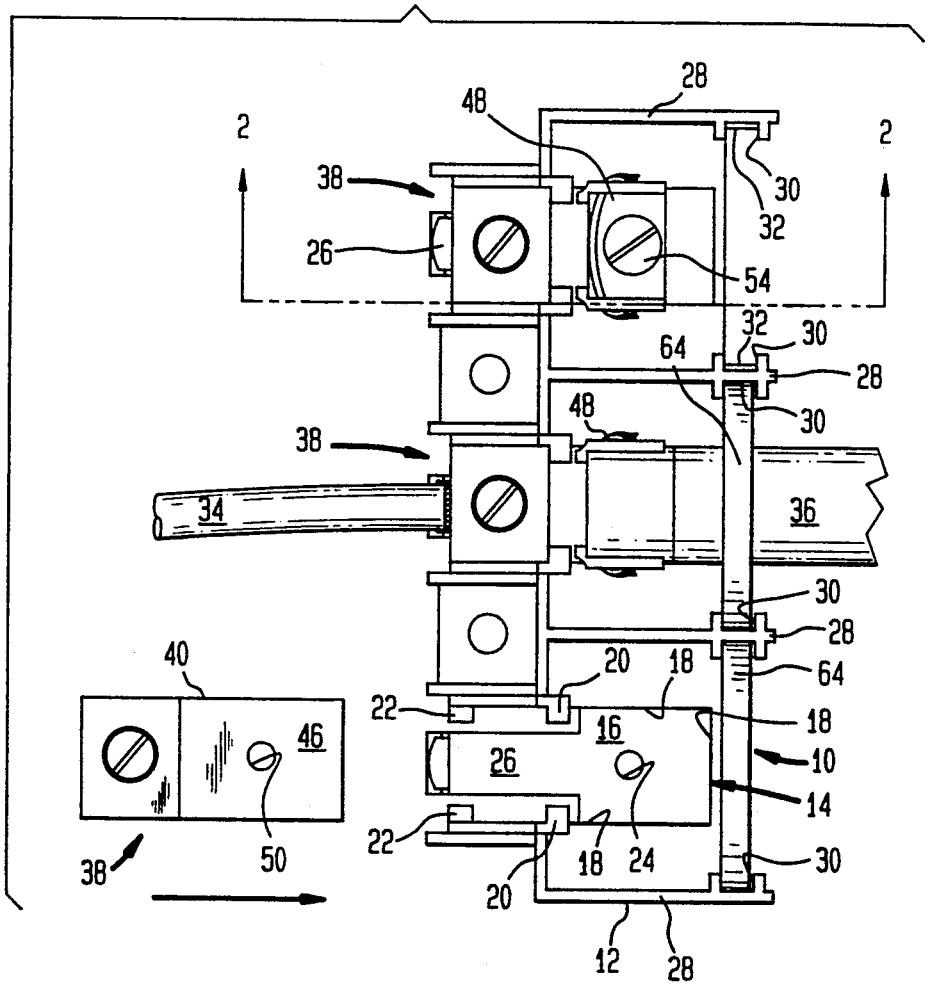
FIG. 1 is a top plan view of the load base of the present invention showing sliding insertion of a wire lug of the present invention into the load base.

In the FIGS., like components are identified with identical reference numerals. Referring to FIG. 1, the load base 10 of the present invention preferably has a three-phase housing 12 which has a unitary construction formed of injection-molded plastic. The housing 12 may also be manufactured of multiple fabrications, such as separate single phases that are joined together. Housing 12 has a channel 14 for each phase, preferably integrally formed in the housing. Each channel 14 is defined by a channel floor 16, three channel sidewalls 18, channel upper detents 20 and channel lower detents 22. Channel floor 16 also has channel floor aperture 24.

Figure 2:
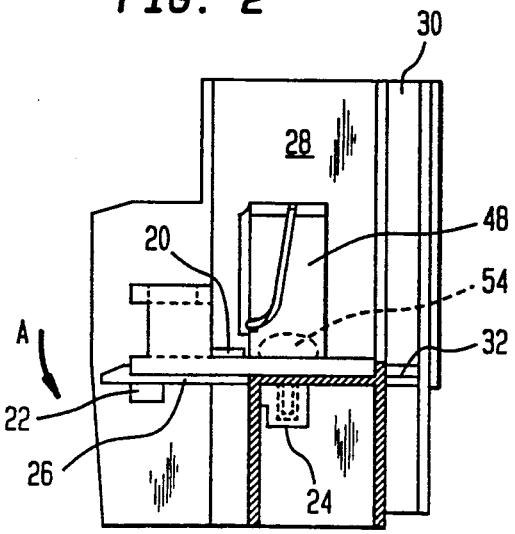
FIG. 2 is an cross-sectional, elevational view of the load base of FIG. 1 taken along 2—2 thereof.
Figure 3:
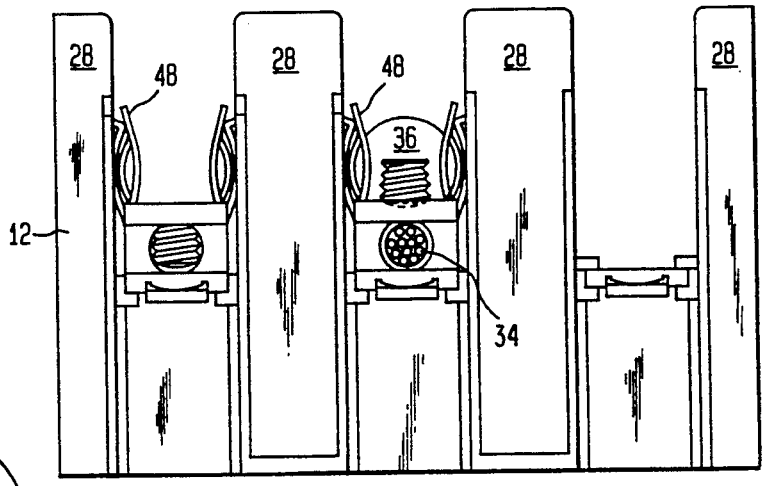
FIG. 3 is a front elevational view of the load base of FIG. 1.

Referring to FIGS. 1 and 2, the housing 12 has a cantileverlike tongue 26 that is preferably integrally formed with the housing 12. The tongue 26 is generally parallel with the channel floor 16, but is biasable in a generally downwardly direction as shown by the arrow A in FIG. 2.

Referring to FIGS. 1–4, the housing 12 has sidewalls 28 which form separate chambers for each of the three phases. The sidewalls 28 have tracks 30. The tracks 30 also have detent ribs 32 which project outwardly from the tracks toward the chamber interiors.

The housing 12 provides the structural support for the electrical components which provide continuity between electrical cable 34 and fuse 36. The housing 12 also insulates the phases from each other to prevent short circuits and ground faults.

Figure 5:
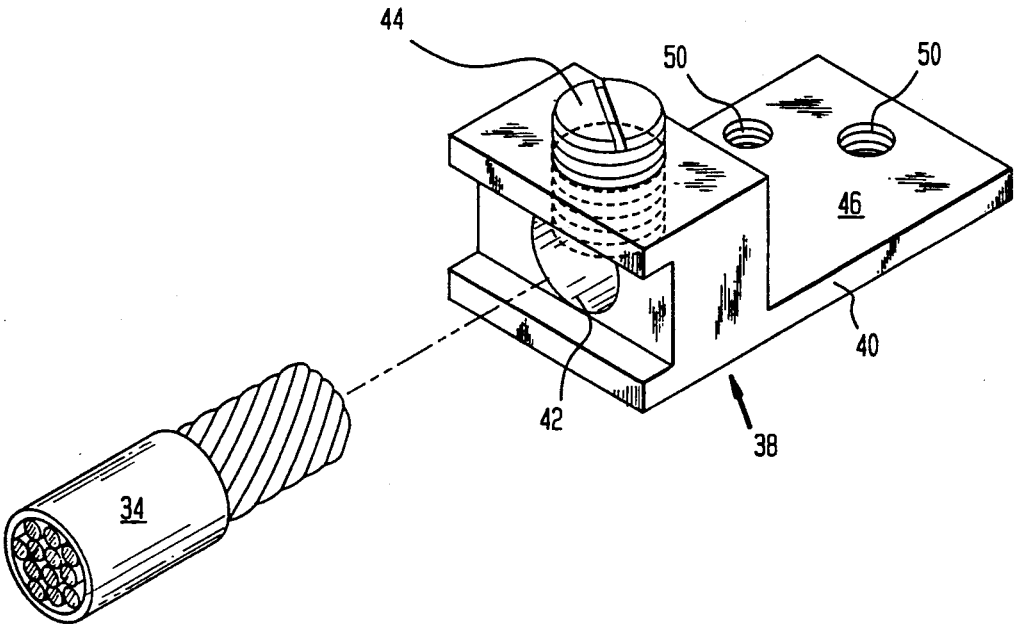
FIG. 5 is a top perspective view of a unitary lug of the present invention.

Referring to FIGS. 1 and 5, wire lug 38 has a lug body 40 which preferably has a unitary cross section and is formed by extrusion. The lug body 40 has a wire aperture 42 for receipt of electrical wire 34 and a wire lug screw 44 for retaining the electrical wire in the wire aperture 42. The lug body 40 forms a platform 46 for direct attachment of a fuse clip 48. Specifically, platform 46 has one or more threaded or unthreaded platform apertures 50, for receipt of a fuse clip threaded member, such as screw 54 which may be of standard or self-tapping construction. The wire lug 38 with integral platform 46 eliminates the need for a separate conductive bus to interconnect the fuse clip 48 with the lug 38.

The fuse clip 48 shown in FIGS. 1 through 4 is designed for use in connection with cylindrical, barrel-type fuses, such as fuse 36, which are often rated for current capacities below 100 amps. The load base, unitary lug and lug retainer features of the present invention are also applicable to larger capacity blade-type fuses, which are often manufactured for capacities of 100 amps or more. Common blade-type fuses are often rated at 100 and 200 amp capacities.

Figure 6:
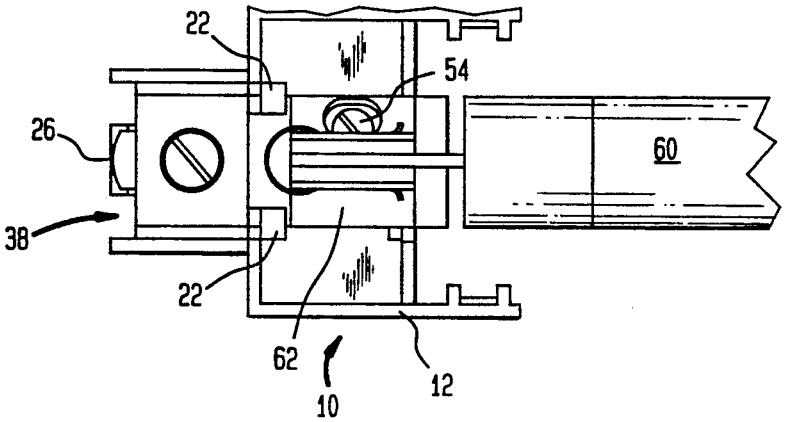
FIG. 6 is a fragmented view of a load base of the type of FIG. 1 shown with a fuse clip which accepts blade-type fuses.

As shown in FIG. 6, a fuse 60 is connected to a blade-type fuse clip 62. The blade-type fuse clip 62 is in turn connected to unitary wire lug 38 by screw 54 that is threaded or screwed into platform aperture 50. Otherwise, the features of the present invention can be practiced for 100 and 200 amp fuse applications as they are with the smaller amperage fuse applications shown in FIGS. 1–4.

The load base 10, wire lug 38, lug retainer channel 14 and tongue 26 of the present invention provide for simplified manufacture and assembly of a load base or similar fusible switch structure. Desirably, the housing 12 is formed as a unitary multi-phase product by an injection-molding process utilizing a suitable thermoplastic of any type well known and recognized in the art for use in load base and switch applications.

After the housing 12 is molded, it can be easily assembled by slidable insertion of the wire lug 38 of the present invention into channel 14, as shown in the lowermost chamber of FIG. 1. After lug 38 is inserted in channel 14 and tongue 26 snaps upwardly to its unbiased, relaxed state, lug 38 is captured in the housing 12 and cannot inadvertently drop out of the base 10.

Next in the assembly, a fuse clip, such as fuse clip 48 in FIGS. 1–4 or fuse clip 62 of FIG. 6, is attached directly to the lug platform 46 with screw 54. The screw 54 may be sized so that its threaded shank does not protrude from the bottom of the lug platform 46, but a longer screw may be used to protrude from the bottom of platform 46 and into the corresponding channel floor aperture 24. When the fuse clip 48 of FIGS. 1 and 2 or 62 of FIG. 6 is installed, the lug 38 cannot be removed.

Figure 4:
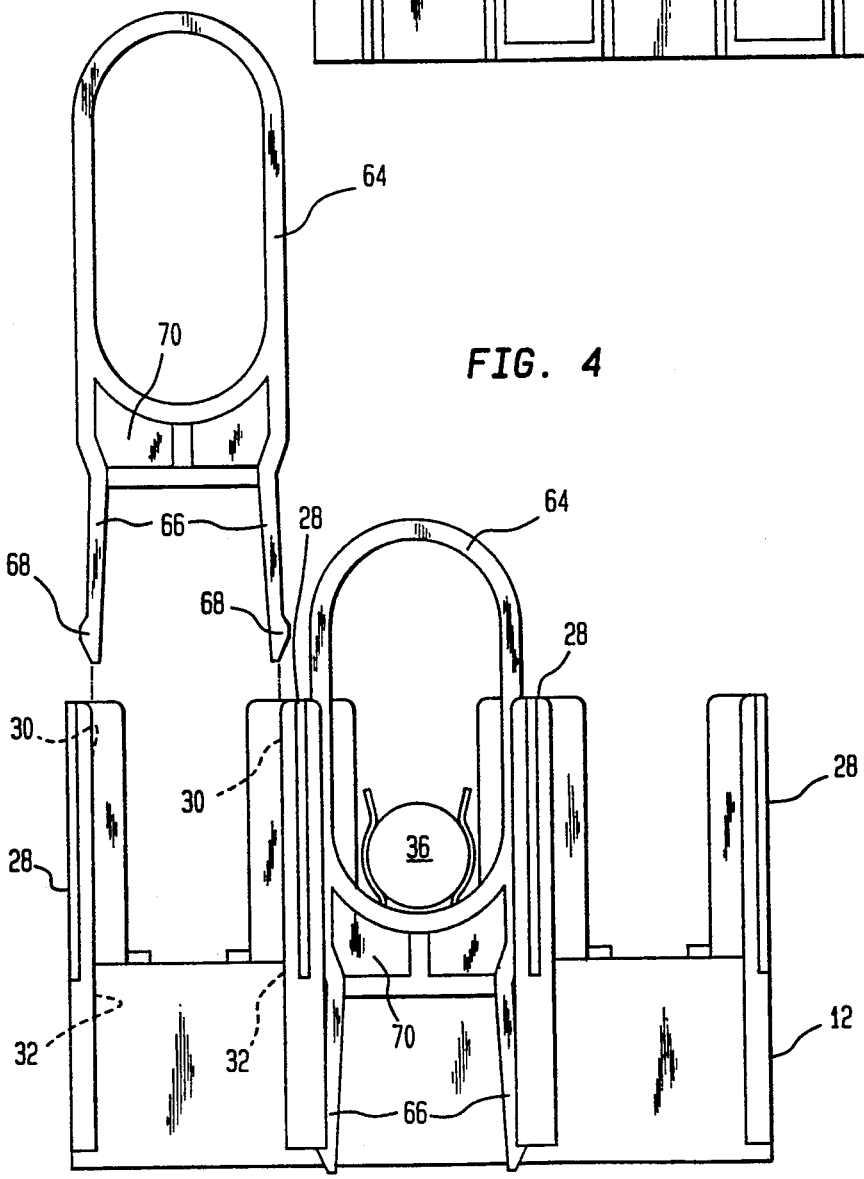
FIG. 4 is a back elevational view of the load base of FIG. 1, showing insertion of a fuse puller.

If desired, a reciprocable fuse puller 64 can be inserted into the tracks 30 after installation of the lug 38 and fuse clip 48, as is shown in FIGS. 1 and 4. Referring to FIG. 4, the fuse puller 64 has a pair of legs 66 and a ramped nib 68 which projects outwardly from at least one, but preferably both of the legs 66 toward each track 30 and rides within the track. The nibs 68 abut against the track detent rib 32 when the puller 64 is reciprocated to a desired end position. The fuse puller 64 has cross member 70 between the legs 66 for abutment against fuse 36 when removing the fuse.

The fuse puller 64 nibs 68 and legs 66 are inwardly self-biasable by exertion of additional upward retraction pressure on the puller 64, so that when desired, the puller is easily removable from the load base 10, yet is retained sufficiently to avoid inadvertent removal from the base. In the most downwardly (rest) position of the fuse puller 64, the bottoms of legs 66 are designed to rest against the surface onto which the load base 10 is mounted. Thus the mounting surface, rather than any portion of the load base 10 limits the down stroke of the fuse puller 64.

The foregoing description of the preferred embodiments is intended to illustrate without limitation the present invention. It is understood that changes and variations can be made therein with departing from the scope of the invention which is defined in the following claims.

What is claimed is:

1. A load base comprising:

a wire lug having a unitary lug body with a wire aperture for receipt of a cable and a platform;

a housing having at least one channel for slidable insertion and capture of the wire lug, the housing having sidewalls projecting from opposite sides of the channel for formation of a fuse clip chamber, where each sidewall has at least one track with a detent rib and the load base has a reciprocable fuse puller which rides in the tracks;

a translatable tongue attached to the housing proximal the channel having a first position which permits slidable insertion of the lug into the channel and a second position which blocks removal of the lug from the channel, where the tongue is a cantilever attached at one end thereof to the housing and is translatable by biasing the tongue; and a fuse clip directly attached to the wire lug platform;

where the fuse puller includes two legs which ride in the tracks, a cross member between the legs for abutment against a fuse in the fuse clip when removing the fuse puller, and a ramped nib projecting outwardly from at least one of the fuse puller legs toward the track for self-biased abutment against the track detent rib when the fuse puller is reciprocated to a desired end position, but which is inwardly biasable by exertion of additional reciprocation pressure on the fuse puller, so that the puller is selectively removable from the load base.

2. The wire lug retainer of claim 1, wherein the housing, channel and tongue are formed as a unitary structure.

3. The wire lug retainer of claim 1, wherein the tongue is formed as a unitary portion of the housing.

4. The wire lug retainer of claim 3, wherein the housing has at least two channels and two tongues for multi-phase applications.

5. The load base of claim 1, wherein the housing has three channels, tongues, lugs and fuse clips for creation of three separate phases and sidewalls separating each phase into individual fuse clip chambers.

6. The load base of claim 5, wherein the sidewalls are integrally formed with the housing, channels and tongues.

* * * * *